US008821204B1

(12) United States Patent
Hoge, Jr.

(10) Patent No.: US 8,821,204 B1
(45) Date of Patent: Sep. 2, 2014

(54) INFLATABLE STAND UP PADDLE BOARD WITH RIGID NEEDLE NOSE

(71) Applicant: Sea Eagle Boats, Inc., Port Jefferson, NY (US)

(72) Inventor: Cecil C. Hoge, Jr., Setauket, NY (US)

(73) Assignee: Sea Eagle Boats, Inc., Port Jefferson, NY (US)

( * ) Notice: Subject to any disclaimer, the term of this patent is extended or adjusted under 35 U.S.C. 154(b) by 31 days.

(21) Appl. No.: 13/773,950

(22) Filed: Feb. 22, 2013

(51) Int. Cl.
*B63B 35/79* (2006.01)

(52) U.S. Cl.
CPC ..... *B63B 35/7913* (2013.01)
USPC ..... 441/66

(58) Field of Classification Search
CPC ..... B63B 35/7913
USPC ..... 441/66, 65, 74
See application file for complete search history.

(56) References Cited

U.S. PATENT DOCUMENTS

| | | | | |
|---|---|---|---|---|
| 486,597 | A | | 11/1892 | Gamble et al. |
| 671,502 | A | | 4/1901 | Sultemeyer |
| 1,206,696 | A | | 11/1916 | Gulbrandsen |
| 1,631,047 | A | | 5/1927 | Meyer |
| 2,018,548 | A | | 10/1935 | Currey |
| 2,986,751 | A | | 6/1961 | Baren |
| 3,335,440 | A | | 8/1967 | Beakbane |
| 3,374,495 | A | * | 3/1968 | William ..... 441/74 |
| D213,597 | S | | 3/1969 | Joyce |
| 3,657,753 | A | | 4/1972 | Le Blanc, Sr. |
| 4,206,933 | A | | 6/1980 | Koch |
| 4,660,497 | A | | 4/1987 | Cochran |
| 4,691,658 | A | | 9/1987 | New et al. |
| 4,807,555 | A | | 2/1989 | Hart |
| 4,864,960 | A | | 9/1989 | Sansoucy |
| 4,955,314 | A | * | 9/1990 | Skedeleski et al. ..... 114/219 |
| D334,419 | S | | 3/1993 | Klein |
| 5,351,637 | A | | 10/1994 | Brenckmann |
| 6,539,889 | B2 | | 4/2003 | Simpson |
| 6,863,014 | B2 | | 3/2005 | Hudson et al. |
| 6,983,715 | B2 | | 1/2006 | Boudeau et al. |
| 7,021,233 | B2 | | 4/2006 | Hall et al. |
| 7,662,006 | B2 | | 2/2010 | Mollis |
| D637,251 | S | | 5/2011 | Bradley |
| 7,987,806 | B2 | | 8/2011 | Chang |
| D662,164 | S | | 6/2012 | Morrelli et al. |
| 8,286,573 | B2 | * | 10/2012 | Hoge, Jr. ..... 114/345 |
| 2003/0153221 | A1 | | 8/2003 | Weir |
| 2009/0049757 | A1 | * | 2/2009 | Potter ..... 52/2.23 |
| 2014/0080369 | A1 | * | 3/2014 | Haller et al. ..... 441/66 |

* cited by examiner

*Primary Examiner* — Edwin Swinehart
(74) *Attorney, Agent, or Firm* — Staas & Halsey LLP

(57) ABSTRACT

An inflatable stand up paddle board includes an inflatable main body made of high pressure drop stitch material; a deck formed on a top portion of the inflatable main body on which a user stands; and a molded needle nose attached to the front of the inflatable main body, the molded needle nose being dimensioned and configured to completely encompass the front of the main body to provide a V-shaped bow, the bottom of the V being the nose of the bow.

11 Claims, 5 Drawing Sheets

INFLATABLE STAND UP PADDLE BOARD WITH RIGID NEEDLE NOSE

BACKGROUND

1. Field

Embodiments relate to watercraft, and more particularly, to an inflatable stand up paddle board with a rigid needle nose.

2. Description of the Related Art

Stand up paddle boards have been known since time immemorial in the Hawaiian Islands. However, the sport of stand up paddle boarding has only recently begun to explode in main stream popularity due to the ease of learning to use a stand up paddle board, the ability for a user to paddle longer distances than by using, for example, their hands, exercise benefits, and the ability of a user to enjoy a high aspect view of their surroundings.

A stand up paddle board typically has a rigid construction. For example, a traditional stand up paddle board was made of wood. Modern stand up paddle boards typically consist of laminated layers over a foam core such as a glass-reinforced plastic construction using polyester or epoxy resin with a polyurethane or expanded polystyrene foam used in the core. A modern stand up paddle board typically ranges between 10-12 feet in length and can weigh over 50 pounds.

Recently, inflatable stand up paddle boards have been introduced. Inflatable stand up paddle boards have the advantage over a rigid stand up paddle board of reduced weight, high durability and ease of transportation. However, one problem with an inflatable stand up paddle board is it necessarily has a rounded bow. This is a particular drawback to inflatable stand up paddle boards because this decreases the speed and maneuverability of the inflatable stand up paddle board and the ability of the inflatable stand up paddle board to cut waves.

Due to these problems and others an inflatable stand up paddle board with a rigid, sharp bow is desired.

SUMMARY

Therefore, it is one aspect of the present invention to provide an inflatable stand up paddle board having a rigid needle nosed bow.

Additional aspects will be set forth in part in the description which follows and, in part, will be apparent from the description, or may be learned by practice of the invention.

According to an aspect, an inflatable stand up paddle board includes an inflatable main body made of high pressure drop stitch material; a deck formed on a top portion of the inflatable main body on which a user stands; and a molded needle nose attached to the front of the inflatable main body, the molded needle nose being dimensioned and configured to completely encompass the front of the main body to provide a V-shaped bow, where the bottom of the V is the nose of the bow.

The high pressure drop stitch material may include a polyester fabric of approximately 1000 denier.

The inflatable main body may be configured to be inflated to at least 15 psi.

The paddle board may have a length of between 9-14 feet.

The paddle board may have a width of between 24-40 inches.

The paddle board may have a thickness of between 3-8 inches.

The paddle board may have a weight between 20-50 pounds.

The inflatable stand up paddle board may further include one or more skegs formed on an after portion of a bottom of the main body. A main skeg may be removable for transport or storage.

The molded needle nose may be attached to the main body by gluing.

The molded needle nose may be made of polyvinyl chloride (PVC) or some other plastic material.

The sides of the molded needle nose may come together in a sharp point at no more than a 40 degree angle.

The molded needle nose may include internal lateral supports that are dimensioned and configured to correspond to the front of the inflatable main body.

BRIEF DESCRIPTION OF THE DRAWINGS

These and/or other aspects and advantages of the invention will become apparent and more readily appreciated from the following description of the embodiments, taken in conjunction with the accompanying drawings in which.

DESCRIPTION OF EMBODIMENTS

Figure 1:
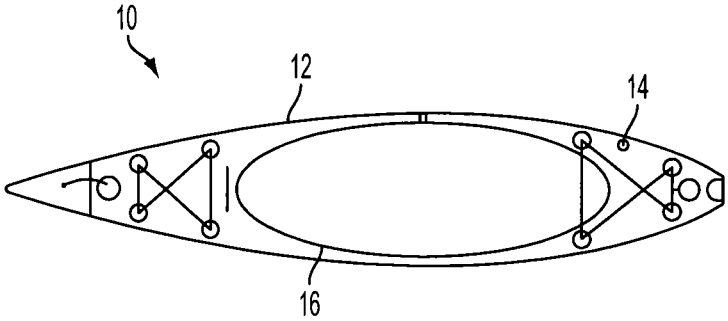
FIG. 1 is top view of an inflatable stand up paddle board in accordance with an embodiment.

Reference will now be made in detail to the embodiments of the present invention, examples of which are illustrated in the accompanying drawings, wherein like reference numerals refer to like elements throughout. The embodiments are described below to explain the present invention by referring to the annexed drawings.

Figure 2:
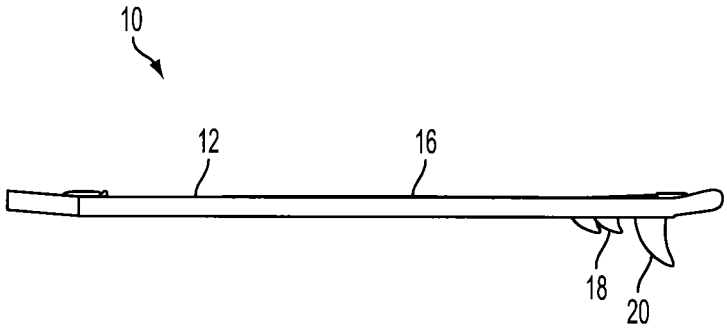
FIG. 2 is a side view of the inflatable stand up paddle board in accordance with the embodiment.
Figure 6:
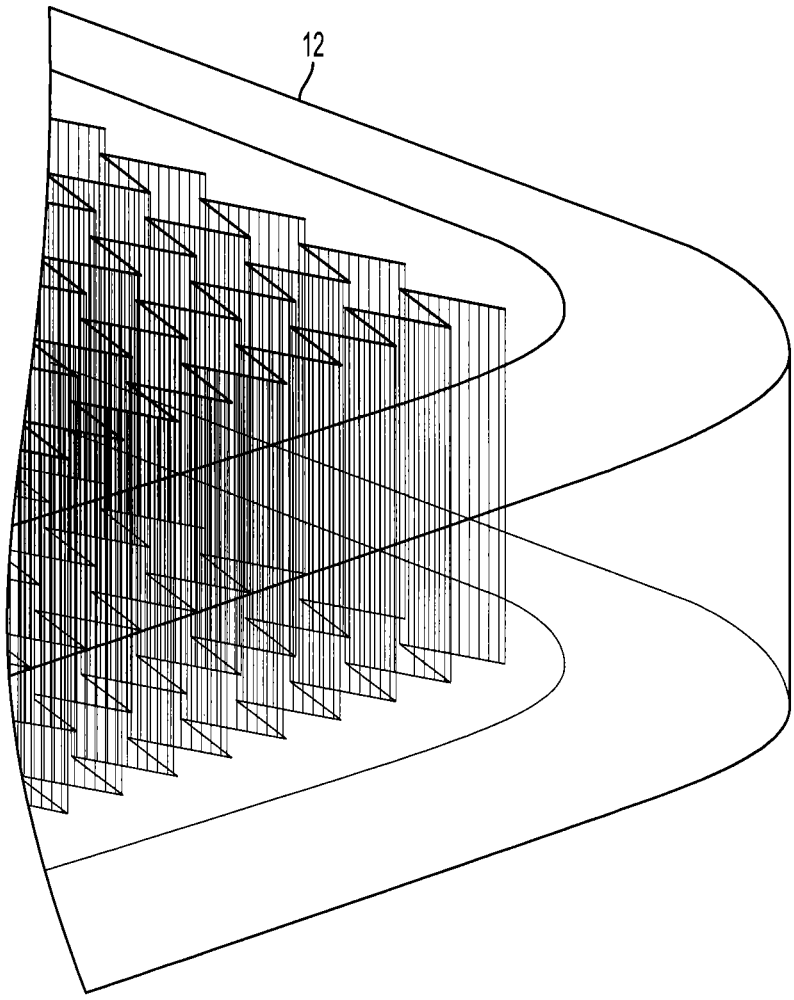
FIG. 6 is a conceptual view of the drop stitch material of the interior of the inflatable stand up paddle board in accordance with an embodiment.

As shown in FIGS. 1 and 2, the inflatable stand up paddle board 10 includes an inflatable main body 12 made of high-pressure drop stitch material. The inflatable main body 12 may be made of 1000 denier polyester fabric but may be made of other stronger or weaker fabric materials. An example of the drop stitch material is shown in FIG. 6 where thousands of drop stitches are provided to maintain an equal distance between the top and bottom surfaces of the inflatable main body 12. The drop stitch threads may be in a linear, zigzag or random pattern. The use of drop stitch material in the main body 12 allows the main body 12 to be inflated to a pressure of 15 psi. The inflatable stand up paddle board 10 may have a length of between 9-14 feet, a width of 24-40 inches, a thickness of between 3-8 inches, and a weight between 20-50 pounds.

The inflatable main body includes an air valve 14. The air valve 14 is preferably a one-way air valve to prevent blow back during inflation, and to make it easier to close the air valve with a valve cap. The air valve 14 may be locked in an open position for fast deflation prior to transportation and storage.

The inflatable main body includes a deck 16 on which a user stands. The deck 16 may be formed of foam or fabric. Skegs 18, 20 are formed on the after portion of the bottom of the inflatable stand up paddle board 10. The skegs 18, 20 may be permanently attached or removable for storage or transportation.

Figure 3:
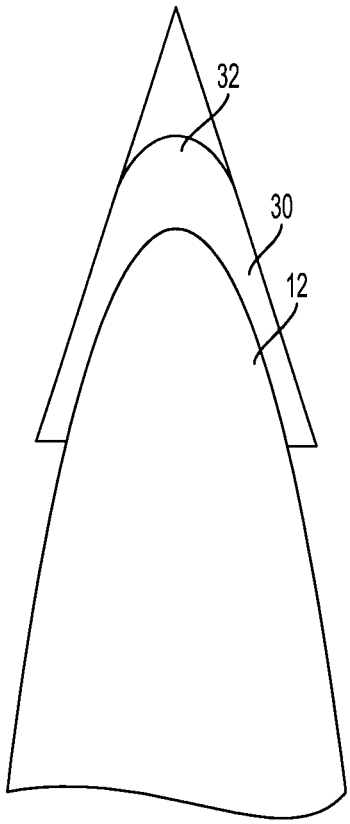
FIG. 3 is a conceptual view of the rigid bow of the inflatable stand up paddle board in accordance with an embodiment.

At the bow portion of the inflatable stand up paddle board 10 is a rigid needle nose. As shown conceptually in FIG. 3, since the drop stitch construction of the main body 12 of the inflatable stand up paddle board 10 precludes having a sharp bow that is effective to cut waves, the inflatable stand up paddle board 10 of the present invention includes a molded needle nose 30 that is attached to the main body 12, for example by gluing.

Figure 4:
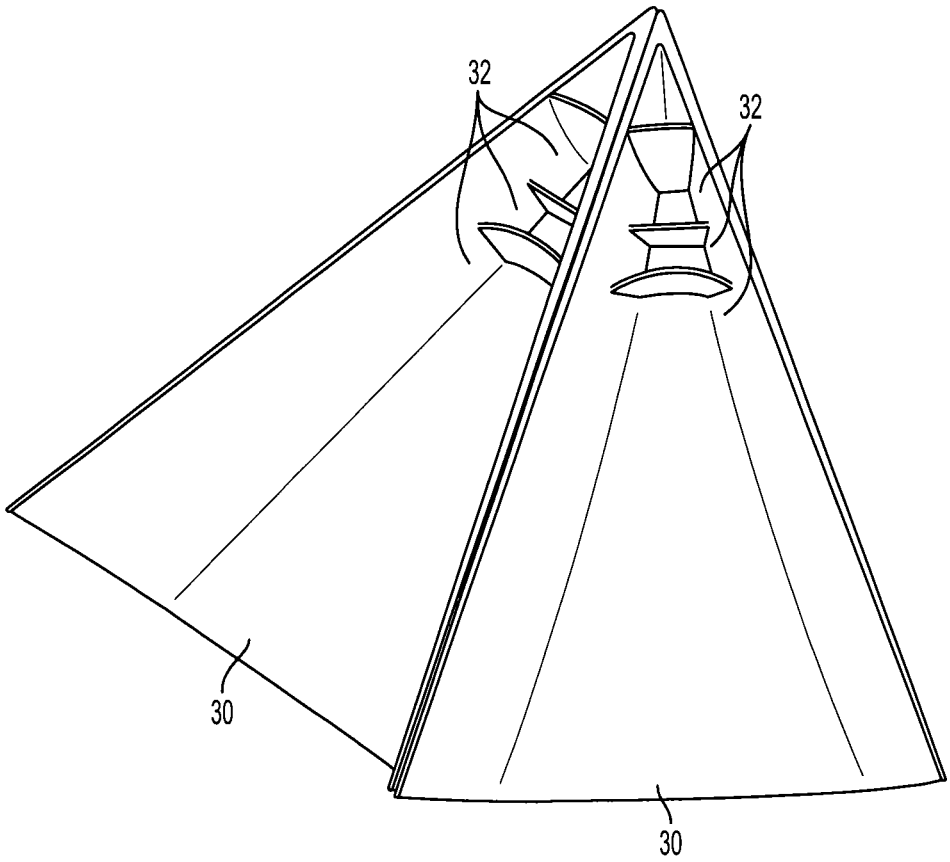
FIG. 4 is a perspective view of the interior of the rigid bow portion of the inflatable stand up paddle board in accordance with an embodiment.
Figure 5:
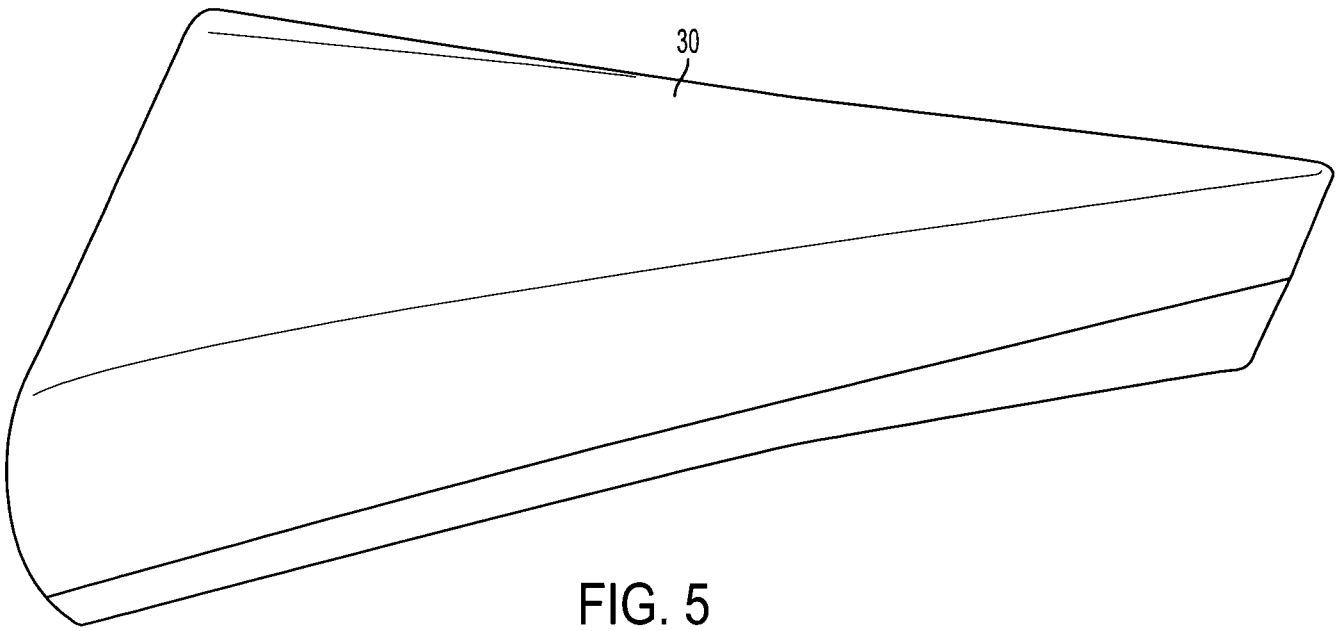
FIG. 5 is a perspective view of the rigid bow portion of the inflatable stand up paddle board in accordance with an embodiment.

As shown in FIGS. 4 and 5, the needle nose 30 of the inflatable stand up paddle board 10 may be made of molded polyvinyl chloride (PVC) construction or other plastic material, although other non-plastic materials may be used. The lateral sides of the needle nose 30 come together in a sharp point at no more than a 40 degree angle. The top and bottom sides of the needle nose are preferably flat and slope towards the sharp point of the needle nose at no more than a 20 degree angle. As shown in FIG. 4, the needle nose may molded in two separate pieces and include internal lateral supports 32 that are dimensioned and configured to correspond to the rounded bow of the inflatable main body 12 to provide additional rigidity after the needle nose 30 is attached to the inflatable main body. Although, the needle nose 30 is shown as being formed in two pieces that are subsequently attached by gluing, the needle nose may be of one piece construction or more than two pieces, and attached to the main body 12 by means other than gluing.

The needle nose 30 gives the inflatable stand up paddle board 10 a rigid, sharp V-shaped, wave piercing bow that enables a user to cut through waves and to paddle faster, further and easier.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. An inflatable stand up paddle board comprising:

an inflatable main body made of high pressure drop stitch material;

a deck formed on a top portion of the inflatable main body on which a user stands; and a molded needle nose attached to the front of the inflatable main body, the molded needle nose being dimensioned and configured to completely encompass the front of the main body to provide a V-shaped bow, wherein sides of the molded needle nose come together in a sharp point at no more than a 40 degree angle, and top and bottom sides of the needle nose are flat and extend towards the sharp point of the needle nose, whereby the molded needle nose provides a wave piercing bow that enables a user to cut through waves.

2. The inflatable stand up paddle board of claim 1, wherein the high pressure drop stitch material comprises a polyester fabric of approximately 1000 denier.

3. The inflatable stand up paddle board of claim 1, wherein the inflatable main body is configured to be inflated to at least 15 psi.

4. The inflatable stand up paddle board of claim 1, wherein the paddle board has a length of between 9-14 feet.

5. The inflatable stand up paddle board of claim 1, wherein the paddle board has a width of between 24-40 inches.

6. The inflatable stand up paddle board of claim 1, wherein the paddle board has a thickness of between 3-8 inches.

7. The inflatable stand up paddle board of claim 1, wherein the paddle board has a weight between 20-50 pounds.

8. The inflatable stand up paddle board of claim 1, further comprising one or more skegs formed on an after portion of a bottom of the main body.

9. The inflatable stand up paddle board of claim 1, wherein the molded needle nose is attached to the main body by gluing.

10. The inflatable stand up paddle board of claim 1, wherein the molded needle nose is made of polyvinyl chloride (PVC).

11. The inflatable stand up paddle board of claim 1, wherein the molded needle nose includes internal lateral supports that are dimensioned and configured to correspond to the front of the inflatable main body.

* * * * *